US005782344A

United States Patent [19]

Edwards et al.

[11] Patent Number: 5,782,344

[45] Date of Patent: Jul. 21, 1998

[54] LIQUID PLASTIC FILM POUCH WITH INNER STRAW

[75] Inventors: John Edwards, Montreal, Canada; Raymond L. Larson, Fargo, N. Dak.

[73] Assignee: Glopak Inc., Montreal, Canada

[21] Appl. No.: 806,126

[22] Filed: Feb. 28, 1997

[51] Int. Cl.[6] ..... B65D 77/28

[52] U.S. Cl. ..... 206/217; 229/103.1

[58] Field of Search ..... 206/217; 215/229, 215/388; 229/103.1; 220/705; 53/469

[56] References Cited

U.S. PATENT DOCUMENTS

| | | | |
|---|---|---|---|
| 2,849,321 | 8/1958 | Lhermitte et al. | 229/103.1 |
| 3,074,612 | 1/1963 | Schneider | 229/103.1 |
| 3,545,604 | 12/1970 | Gunther, Jr. | 206/217 |
| 3,730,337 | 5/1973 | White | 206/217 |
| 3,799,914 | 3/1974 | Schmit et al. | 229/103.1 |
| 4,762,514 | 8/1988 | Yoshida | 229/103.1 |
| 4,806,021 | 2/1989 | Koudstaal et al. | 229/103.1 |
| 5,334,400 | 8/1994 | Purdham | 206/217 |

*Primary Examiner*—David T. Fidei

*Attorney, Agent, or Firm*—Guy Houle; David M. Carter

[57] ABSTRACT

A liquid product carrying plastic film pouch (10) having a straw (12) free-floating in the liquid product (11) is described. The liquid product (11) contained within the inner chamber (13) of the pouch occupies from about 60% to about 90% of the volume of the inner chamber (13) of the pouch and a portion of air from the remaining volume is evacuated in sufficient quantity to permit the side walls (14,15) of the pouch to be collapsed against one another when the pouch is grasped by the hand of a user person. By collapsing the side walls (14,15) together the straw (12) located within the liquid can be grasped and manipulated to puncture the plastic film pouch (1) to extend a portion (12') of the straw (12) exteriorly of the pouch whereby to extract liquid therefrom. The pouch (10) is made of a multilayer resin film having an inner sealant layer (26) formed of a linear low density ethylene-octene copolymer or very low density ethylene copolymer (octene or other copolymers) such that when the straw punctures the film, the inner sealant layer (26) forms a membrane about the straw which exhibits a self-sealing behavior so as to prevent leakage in the punctured region as liquid is extracted from the pouch (10) through the straw (12).

10 Claims, 3 Drawing Sheets

LIQUID PLASTIC FILM POUCH WITH INNER STRAW

TECHNICAL FIELD

The present invention relates to a sealed plastic film pouch having a liquid and a free-floating straw therein and wherein air is evacuated from a space within the pouch to facilitate the manipulation of the pouch by collapsing its side walls to grasp the straw and puncture the pouch, and further wherein the bag is formed from a multilayer film having an inner sealant layer exhibiting a self-sealing behavior about the straw in the punctured area to provide a seal about the straw.

BACKGROUND ART

It is known to form package liquid containers with sealed plastic bags and wherein a straw-like object or extractor is held inside the bag and freely floating within the liquid contained therein. Such a liquid pouch container is, for example, described and illustrated in U.S. Pat. No. 3,730,336 issued on May 1, 1973. Such package containers, however, have disadvantages in that it becomes difficult to manipulate the bag to grasp the straw and puncture the bag due to the amount of liquid and air held captive within the sealed bag. This manipulation often causes the bag to burst. It is also important to have an added extra volume within the bag in the event that it is desirable to freeze the package with its liquid content as the extra volume will permit for expansion of the freezing liquid content.

It is desirable with such bags to provide straws with sufficient rigidity, such as polypropylene to puncture the bag without having an end of the straw cut on the bias and without having any means attached to the straw to permit its grasping to facilitate its movement within the bag as such means pose other disadvantages in the automatic assembly of the pouch with its liquid contents. It is also desirable with such package liquid containers to provide a container which is highly hygienic and which is formed of plastic material which will not impart off-taste (acidic taste) to a liquid contained therein and particularly if the liquid is present for a long period of time. It is further desirable with such packages to extend the shelf life thereof so that such packages with their liquid content can be maintained a long period of time before being used. It is also desirable to provide a plastic film pouch which can provide a seal about the straw when the bag is punctured and which can resist impact during handling and shipping

SUMMARY OF INVENTION

It is therefore a feature of the present invention to provide a plastic film pouch which overcomes the above-mentioned disadvantages of the prior art and which provides for the needs as above-mentioned.

Another feature of the present invention is to provide a sealed plastic film pouch having a liquid and a free-floating straw therein and wherein a predetermined quantity of air has been evacuated from a space contained within the inner chamber of the pouch.

Another feature of the present invention is to provide a sealed plastic film pouch containing a liquid and a free-floating straw therein and wherein the plastic film is a multilayer film having an inner sealant layer possessing a substantially self-sealing behavior about the straw in a punctured area of the bag when in use whereby to provide a seal about the straw.

Another feature of the present invention is to provide a method of forming a plastic film pouch with a liquid and straw disposed in the pouch and which substantially overcome the above disadvantages of the prior art and which meets the required needs.

According to the above features, from a broad aspect, the present invention provides a plastic film pouch for containing a liquid product. The film pouch has opposed side walls sealed about a peripheral edge thereof to define a sealed inner chamber. At least a portion of at least one of the side walls is formed of transparent film for visual access to the inner chamber. A straw of predetermined rigidity is located freely within the inner chamber. A liquid is contained within the inner chamber and occupies from about 60% to about 90% of the volume of the inner chamber. The remaining volume of the inner chamber has air evacuated therefrom in sufficient quantity to permit the side walls to be collapsed against one another to facilitate grasping the straw in the liquid and manipulating it to puncture the plastic film pouch whereby to extend a portion of the straw exteriorly of the pouch to extract liquid from the pouch.

According to a further broad aspect of the present invention, there is provided a method of forming a plastic film pouch with a liquid and straw disposed in the pouch. The method comprises the steps of drawing a film web having opposed side walls positioned in juxtapose to a filling and sealing station. Edge seals are formed at the filling and sealing station to form a pouch having an open-top-end and defining an inner chamber. A straw, having a predetermined rigidity, is inserted in the inner chamber through the open-top-end. A predetermined volume of liquid is then inserted in the inner chamber through the open-top-end to occupy from about 60% to about 90% of the volume of the inner chamber and thereby defining a vacant space thereabove. The opposed film side walls are then collapsed together in a portion of the vacant space to expel air therefrom through the open-top-end. A top edge of the two juxtaposed side walls are then sealed together adjacent the open-top-end whereby to form a pouch having a liquid and a free-floating straw therein with air evacuated in sufficient quantity to permit liquid to be displaced within the inner chamber when opposed side walls of the pouch are collapsed towards one another to grasp the straw in the liquid and to manipulate it to puncture the plastic film whereby to extend a portion of the straw exteriorly of the pouch to extract liquid from the pouch.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
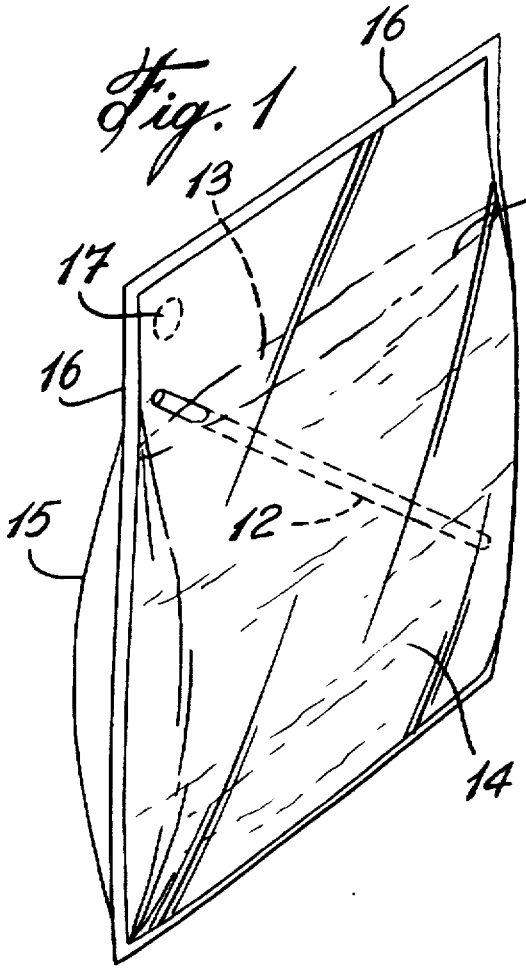
FIG. 1 is a perspective view showing a plastic film pouch constructed in accordance with the present invention and wherein a liquid and a straw is contained within an inner chamber formed by the sealed pouch.

Referring now to the drawings and more particularly to FIG. 1, there is shown generally at 10 the sealed plastic film pouch of the present invention. A liquid product 11, as well as a free floating straw 12, are contained within an inner chamber 13 of the pouch 10. The plastic film pouch has opposed side walls 14 and 15 which are sealed about a peripheral edge 16 thereof. As hereinshown the pouch 10 is formed of transparent film material whereby to provide visual access to the free-floating straw 12 and the liquid product. Of course, the film material may be printed while still providing visual access to the inner chamber thereof. As hereinshown the front side wall 14 is provided with a printed target area 17 to indicate to the user where it is preferable to puncture the bag, although the straw can be oriented to puncture other areas, but the corners are preferred.

The liquid product 11 contained within the bag occupies from about 60% to about 90% of the volume of the inner chamber 13. The remaining volume of the inner chamber has a portion of air evacuated therefrom in sufficient quantity to permit the liquid to be displaced by collapsing the side walls against one another to facilitate grasping of the straw. Preferably, although not exclusively, the liquid product contains approximately 84% of the volume of the inner chamber. Also, these pouches are preferably, although not exclusively, dimensioned to contain liquid products in volumes from 3 ounces to 24 ounces.

Figure 2A:
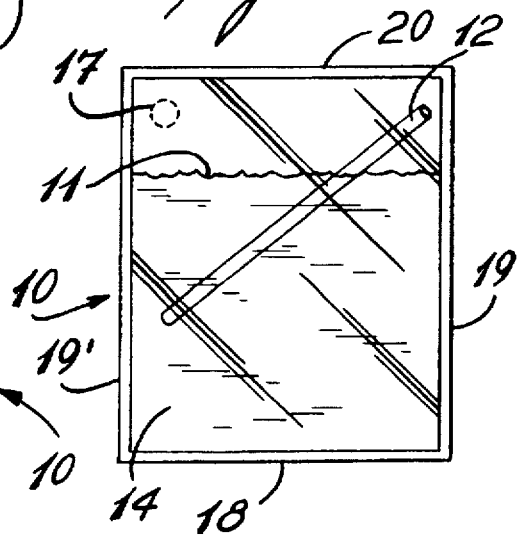
FIG. 2A is a plan view of the plastic film pouch of FIG. 1 and wherein the pouch is formed entirely of transparent plastic materials.
Figure 2B:
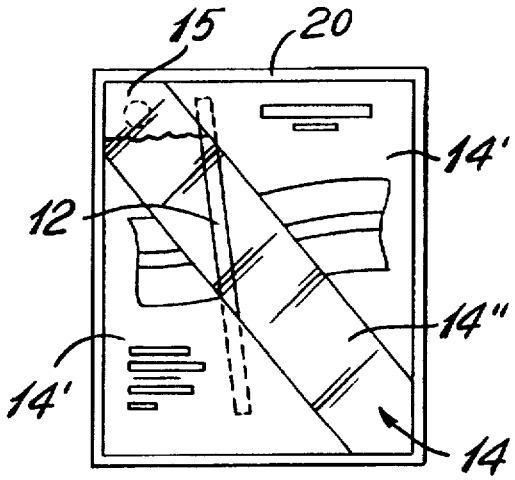
FIG. 2B is a plan view showing the plastic film pouch formed with an opaque rear wall and a partly opaque and partly transparent front wall.

As shown in FIGS. 2A and 2B, the plastic film pouch 10 is of rectangular shape and is provided with a bottom seal 18, opposed side seals 19 and 19' and a top seal 20 about the opposed side walls 14 and 15 whereby to form a rectangular transparent film pouch. It is pointed out that the film pouch need not be entirely transparent and as shown in FIG. 2B, the rear side wall 15 is formed with a pigment to provide a solid colored wall which is not transparent. On the other hand, the front wall 14 may have opaque colors printed on portions 14' thereof while maintaining a large transverse transparent section 14' for visual access of the straw 12 located within the pouch. Of course, printed matter may also be applied across the transparent section 14", provided one can still see through the transparent section to locate the straw.

Figure 3:
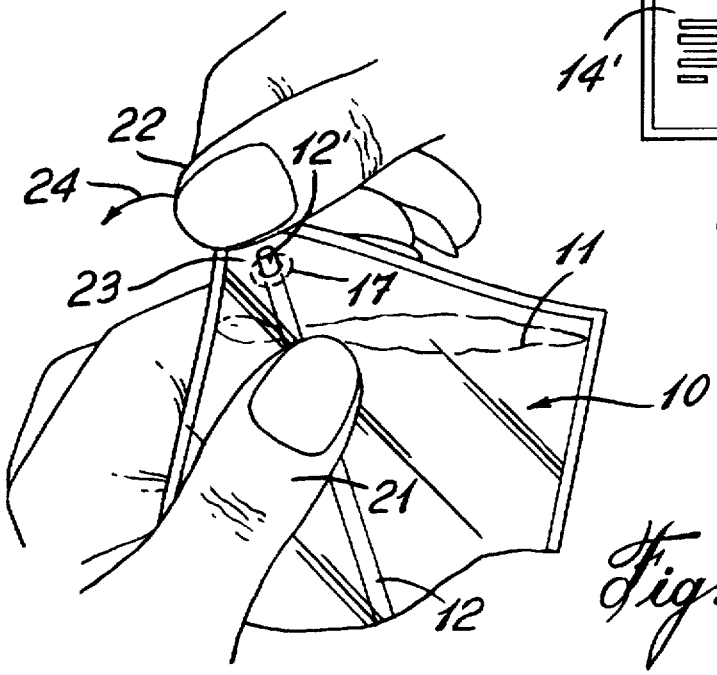
FIG. 3 is a perspective view showing how the straw inside the plastic film pouch is manipulated to puncture a corner portion of one of the side walls whereby a portion of the straw can be exposed to extract liquid from the pouch.
Figure 4:
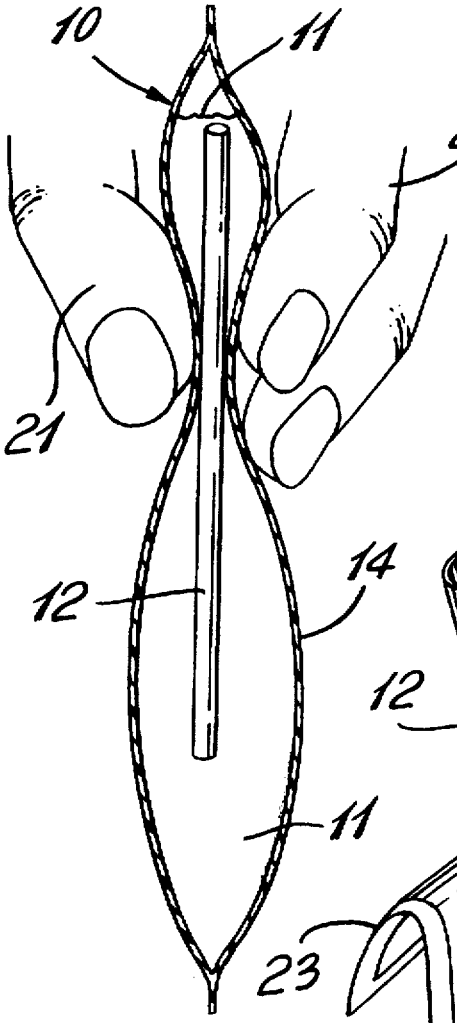
FIG. 4 is a perspective view showing the pouch partly in section to show how the side walls of the pouch are collapsed to grasp the straw.
Figure 5:
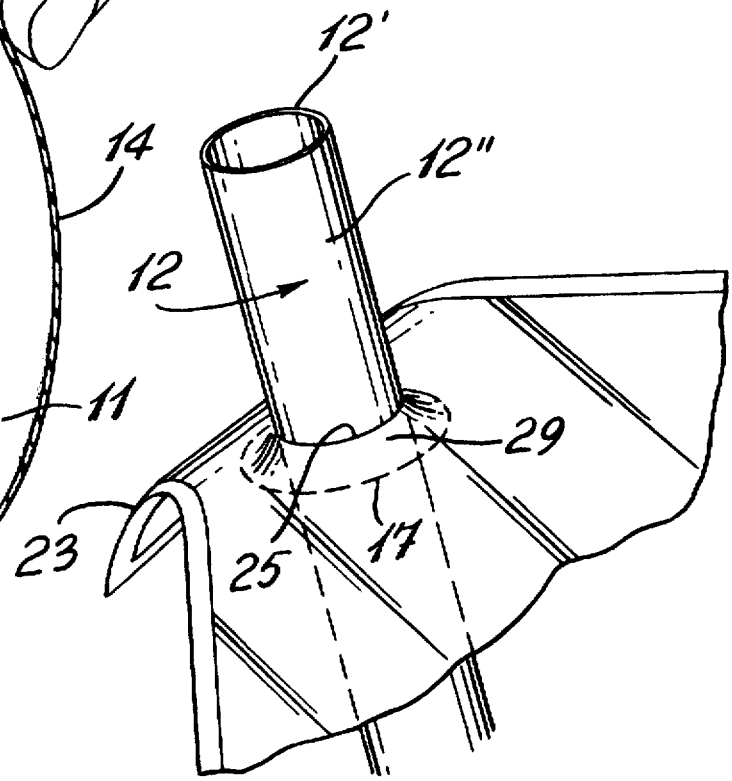
FIG. 5 is an exploded view showing a sealing membrane formed about the straw by the inner sealant layer of the film which exhibits a self-sealing behavior.

With reference now to FIGS. 3 to 5, there will be described the manner in which the plastic film pouch is used to puncture it with the inner straw and to extract the liquid. As shown in FIG. 4, because air has been evacuated from the pouch, it is possible to collapse the opposed side walls 14 and 15 by pinching the pouch with the fingers 21 to grasp the straw 12 with one hand. This permits the user to manipulate the straw to position an end thereof adjacent the target area 17 as shown in FIG. 3. With the fingers 22 of the other hand, the user grasps a corner area 23 of the pouch and folds it downwardly in the direction of arrow 24 against the straw free end 12' with the target area 17 or an area close thereto being pulled against the free end 12' whereby the free end 12' will puncture the film and exit the bag as shown in FIG. 5.

Figure 6:
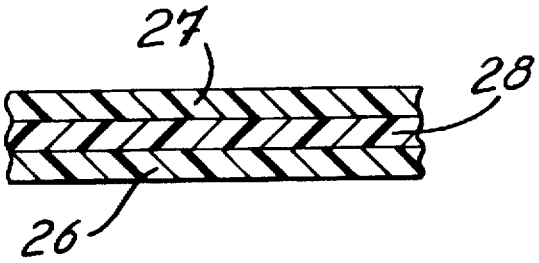
FIG. 6 is a section view showing the composition of the multilayer resin film.

In order to obtain a good seal between the straw side wall 12" and the punctured hole 25, a multilayer resin film material having an inner sealant layer 26 is utilized. Such a multilayered film material is illustrated in FIG. 6 and it consists of a laminated or extrusion-coated plastic film comprising an inner sealant layer 26 which is selected from a linear low or very low density ethylene-octene copolymer or a metallocene linear low density polyethylene. Preferably, the sealant layer has a density of 0.900 g/cm$^3$ and above. The co-extruded resin film also has at least a different outer polymer 27 or an additive which is preferably a multilayer resin film blend of high pressure polyethylene or other linear low density ethylene-octene copolymer. It may also have a pigmented resin core 28 if it is desirable to form the pouch with an opaque back wall 15 as previously described. The core could be a barrier material, such as Nylon, PET, PVDC, PP EVOH, for example. Such a multilayer resin film provides for the fabrication of a pouch having excellent impact and flexural properties to prevent leaking and exhibits low heat seal initiation temperatures to permit high speed sealing of the pouch. It is preferable with these pouches that they be strong and defect-free, that is to say that there are no pin holes or folds which could lead to leaking pouches.

As the pouches are typically made on a vertical formed fill seal packaging machine, the hot tack properties of the film are important. The multilayer film as shown in FIG. 6 combines different resins or additives in one or more layers in order to achieve specific performance properties of the pouch 10. As above-described, the important aspect of this multilayer film is the inner sealant layer 26. Metallocene low density ethylene-octene copolymer is preferred as it does not impart off-taste, that is to say it does not impart an acidic taste to the liquid product when contained within the bag over a long period of time. It also improves the shelf life of the liquid product within the pouch. Another polymer material such as EVOH or PET could be used to provide barrier characteristics to the pouch. Furthermore, lower cost LLDPE butene or LDPE could be used in the core to reduce costs.

With reference to FIG. 5 it can therefore be appreciated that because the inner sealant layer 26 exhibits a substantially self-sealing behavior about the straw, it forms a sealing membrane 29 all about the straw side wall 12" to prevent liquid from seeping through the punctured hole 25. The liquid product from the straw can be extracted by squeezing the bag to expulse the liquid through the straw 12 or else the liquid may be sipped out of the pouch through the free end 12' of the straw.

Figure 7:
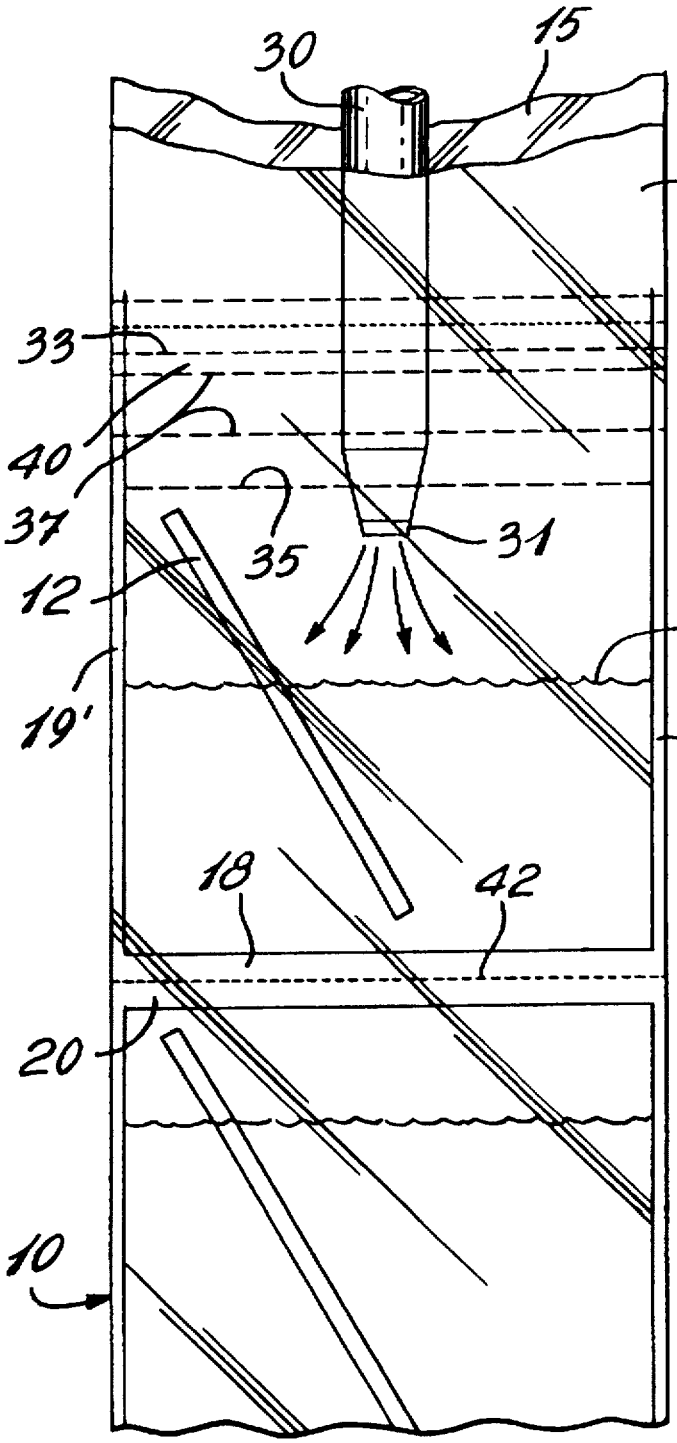
FIG. 7 is a simplified side view illustrating the method of forming the plastic film pouch with the liquid and straw inserted therein and the manner in which air is evacuated and in which the bag is sealed.
Figure 8:
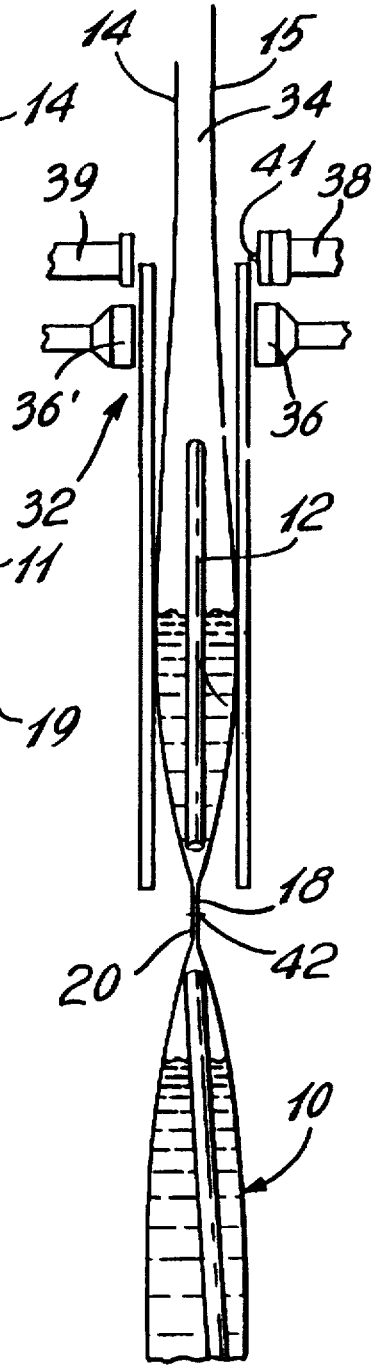
FIG. 8 is a simplified side section view further illustrating how the bag is formed and particularly how air is extracted from the bag and how the top and bottom seals are formed.

With reference now to FIGS. 7 and 8, there will be described the method of forming the plastic film pouch 10 of the present invention with a liquid 11 and a straw 12 disposed in the pouch. This pouch 10 is formed in a vertical form fill seal packaging machine, not shown, and in which the two film sheets 14 and 15 are brought in juxtaposition but separated from one another, as shown in FIG. 7, and drawn on opposed sides of a filler tube 30. The liquid product 11 flows from the dispensing end 31 of the filler tube after the bottom seal 18 and side seals 19 and 19' have been formed. Accordingly, the two plastic resin film sheets 14 and 15 are drawn in juxtaposition to a sealing and filling station 32 which is shown in FIGS. 7 and 8. At this station the side seals 19 and 19' are formed as the bottom seal 18 was already formed when the top end of the bag was sealed, as will be described. The seals may be formed using impulse or constant heat techniques or using any other convenient sealing system, such as ultrasonic sealing.

By forming the side seals 19 and 19' a pouch having an open top end 33 is formed. The straw 12 is then injected into the open top end pouch by a straw injector (not shown) through the space 34 as shown in FIG. 8. The filler tube then quickly dispenses a predetermined quantity of liquid product within the open ended pouch and as previously mentioned this product will fill from about 60% to about 90% of the volume of the inner chamber of the pouch and preferably, but not exclusively, 84% of this chamber. During the filling, the pouch can also be held by clamps, not shown. As soon as the liquid is dispensed the filler tube 30 is retracted with the liquid product reaching its maximum level as indicated by reference numeral 35. Alternatively, the open-top-end pouch could be advanced after the filling. As soon as the filler tube is retracted, or its pouch advanced, a pair of clamping arms 36 and 36' will clamp the bag in the area depicted between the broken lines 37, as shown in FIG. 6, and spaced from the open top end 33 of the bag, whereby to expel air from the space on top of the liquid level surface 35. The heat sealing head 38 and its back plate 39 then move together to seal the top edge portion 40 of the open-top-end bag to form the top seal 20 and simultaneously the bottom seal 18 of the next bag to be formed is also formed. As hereinshown the sealing head 38 is provided with a series of perforating prongs 41 to form a perforated line 42 between the seals 18 and 20 whereby the bags can be later separated from the strip of bags being formed, as shown in FIG. 8.

It is within the ambit of the present invention to cover any obvious modifications of the preferred embodiment described herein, provided such modifications fall within the scope of the appended claims.

We claim:

1. A plastic film pouch for containing a liquid product, said film pouch having opposed side walls sealed about a peripheral edge thereof to define a sealed inner chamber, at least a portion of at least one of said side walls being formed of transparent film for visual access to said inner chamber, a straw of predetermined rigidity located within said inner chamber, said straw having a length shorter than said side wall, a liquid within said inner chamber, said straw being free floating in said liquid and displaceable in said liquid across said side walls of said chamber, said liquid contained within said inner chamber occupying from about 60% to about 90% of the volume of said inner chamber, the remaining volume of said inner chamber having a portion of air evacuated therefrom in sufficient quantity to permit said liquid to be displaced within said inner chamber when said side walls are collapsed towards one another to grasp said free floating straw in said liquid and manipulate it to puncture said plastic film pouch whereby to extend a portion of said straw exteriorly of said pouch to extract liquid from said pouch.

2. A pouch as claimed in claim 1 wherein said liquid product contains approximately 84% of said volume of said inner chamber.

3. A pouch as claimed in claim 1 wherein indicator means is provided on an exterior surface of said pouch in a top corner area thereof to indicate to a user person where to orient a free end of said straw intended to puncture said bag.

4. A pouch as claimed in claim 1 wherein said pouch is dimensioned to contain said liquid product in volumes from 3 ounces to 24 ounces.

5. A pouch as claimed in claim 1 wherein said plastic film is a multilayer film having an inner sealant layer and at least a different outer polymer or additive, said inner sealant layer being a low density copolymer or polyethylene which does not impart acidic taste.

6. A pouch as claimed in claim 5 wherein said inner sealant layer is selected from a linear low or very low density ethylene copolymer, or metallocene linear low density polyethylene.

7. A pouch as claimed in claim 6 wherein said inner sealant layer has a density of 0.900 g/cm$^3$ and above.

8. A pouch as claimed in claim 5 wherein said multilayer film is composed of a blend of linear low, very low density or metallocene polyethylene with high pressure polyethylene or other linear low density ethylene-octene copolymer to provide a pouch with excellent impact and flexural properties and to prevent leaking, said multilayer resin film also exhibiting low heat seal initiation temperatures to permit high speed sealing of said pouch.

9. A pouch as claimed in claim 5 wherein said inner sealant layer of said multilayer resin film forms a membrane which exhibits a substantially self-sealing behavior about said straw in the area of said puncture due to the fact that the yield point of said inner sealant layer has not been exceeded.

10. A pouch as claimed in claim 6 wherein said ethylene copolymer is octene or other copolymer.

* * * * *

Disclaimer 5,782,344—John Edwards, Montreal, Canada; Raymond L. Larson, Fargo, N. Dakota. LIQUID PLASTIC FILM POUCH WITH INNER STRAW. Patent dated July 21, 1998. Disclaimer filed October 4, 2000 by the assignee, South Dakota Limited Liability Company.

Hereby enters this disclaimer to claims 5, 6, 7, 8, 9 and 10 of said patent

*(Official Gazette, August 13, 2002)*